US005733172A

United States Patent [19]

Nishimura et al.

[11] Patent Number: 5,733,172

[45] Date of Patent: Mar. 31, 1998

[54] DRY BARREL FINISHING MACHINE HAVING A DEVICE TO WET MEDIA

[75] Inventors: Kazutoshi Nishimura, Niwa-gun; Masatomo Watanabe, Hashima; Takao Ishida, Nishikasugai-gun; Satoshi Niwa, Ama-gum; Mikitoshi Hiraga, Iwakura, all of Japan

[73] Assignee: Sintobrator, Ltd., Nagoya, Japan

[21] Appl. No.: 651,333

[22] Filed: May 22, 1996

[30] Foreign Application Priority Data

May 23, 1995 [JP] Japan ..... 7-123935

[51] Int. Cl.[6] ..... B24B 31/00

[52] U.S. Cl. ..... 451/32; 451/326; 451/327

[58] Field of Search ..... 451/32, 33, 34, 451/35, 85, 326, 327, 328, 329, 330

[56] References Cited

U.S. PATENT DOCUMENTS

| | | | |
|---|---|---|---|
| Re. 27,412 | 6/1972 | Olson et al. | 451/32 |
| 2,465,632 | 3/1949 | Burns | 451/328 |
| 2,476,078 | 7/1949 | Banks | 451/328 |
| 3,008,274 | 11/1961 | Welter | 451/326 |
| 3,161,997 | 12/1964 | Balz | 451/35 |
| 3,436,868 | 4/1969 | Christensen | 451/326 |
| 3,513,604 | 5/1970 | Masahisa Matsunaga et al. | 451/32 |
| 3,715,840 | 2/1973 | Davidson | 451/326 |
| 4,115,960 | 9/1978 | Zecher | 451/32 |
| 4,257,196 | 3/1981 | Walther et al. | 451/35 |
| 4,796,388 | 1/1989 | Steckis | 451/33 |
| 4,884,372 | 12/1989 | McNeil | 451/328 |
| 5,119,597 | 6/1992 | Davidson | 451/326 |
| 5,140,783 | 8/1992 | Hoffman | 451/32 |
| 5,279,074 | 1/1994 | Davidson | 451/326 |
| 5,460,566 | 10/1995 | Trahan | 451/326 |
| 5,476,415 | 12/1995 | Nishimura et al. | 451/326 |

FOREIGN PATENT DOCUMENTS 63-59821 11/1988 Japan .

*Primary Examiner*—Timothy V. Eley
*Assistant Examiner*—Derris H. Banks
*Attorney, Agent, or Firm*—Fish & Neave; Jeffrey H. Ingerman

[57] ABSTRACT

A dry barrel finishing machine is disclosed. The machine includes a device to drip or spray water to wet the surface of media. The faucet of the device is located adjacent or in the barrel or barrels of the finishing machine so that it can spray water on media in the barrel or barrels. The media is cooled by the sprayed water. Since the sprayed water wets and softens the surface of the media, attrition dust on the surface of the media is easily removed during attrition. Also, since the wetted surface of the media tends to peel, it is self-sharpened. Thus the media always keeps its abrasive ability.

11 Claims, 6 Drawing Sheets

DRY BARREL FINISHING MACHINE HAVING A DEVICE TO WET MEDIA

BACKGROUND OF THE INVENTION

1. Field of the Invention

This invention relates to a method and a machine for finishing surfaces of workpieces by media in a dry barrel or barrels in which a mass comprised of workpieces and media flows, and, in particular to such a method and machine wherein the media is wetted to a minimum.

2. Description of the Prior Art

In conventional dry barrel finishing wherein a mass, which includes workpieces and media, is moved in a barrel or barrels to finish the surfaces of the workpieces, dust, such as attrition dust and tiny fragments, is caused. This dust adheres to the surface of the media, thereby causing a loading of the media (state of a media surface being covered with dust). Thus the ability of the media to abrade workpieces lowers. Further, the dust adheres to the surfaces of the workpieces, thereby charting their color to a dark one. Thus the value as products of the processed workpieces lowers.

To eliminate these drawbacks, the media may be taken out and washed down during the process to remove dust that adheres to its surface. However, this method requires not only stopping the process, but also post-treating the sewage caused by washing the media. Thus the advantage of the dry barrel finishing is spoiled.

Further, a method may be used whereto used media, containing a loading, and dressing abrasives, are put in a barrel, and wherein the barrel is operated to remove the dust from the surface of the media to recover it. However, in this method also, the process is stopped, and the rate of abrading is limited to a lower one.

Herein the term "to dress" means to clean the surface of media of dust and to recover the media.

To carry such dust in the air outside the barrel has been tried by the assignee of this patent application so as to enhance the rate of abrading and the value of the products. This method gives good results to some extent, but presents difficulties in enhancing the abrading rate and the value of the products to a high rate and value that have been recently required in the art. A method that gives a higher rate of abrading and high-grade products has been required.

SUMMARY OF THE INVENTION

This invention was conceived based on the discovery that media is dressed and cooled if just its surface is wet by a suitable amount of a solution.

The purpose of the invention is to provide a dry barrel finishing machine having a device that sprays or drips a solution on the surface of media to wet the surface.

Another purpose of the invention is to provide a method of dry barrel finishing that includes the step of adding a suitable amount of a solution in a barrel such that only the surface of the media is wetted, but its inside is not wetted.

A further purpose of this invention is to provide a method for dressing media, including the steps of causing the media to flow in a barrel, and adding a suitable amount of a solution in a barrel such that only the surface of the media is wetted, but the inside is not wetted. This method is especially suitable for media that includes a resin binder that absorbs moisture.

According to this invention, only the surface of the media is suitably wetted. This eliminates the loading of the media, and cools it, and enhances its self-sharpening. Thus the rate that workpieces can be abraded is enhanced, and changes to their color are prevented.

DESCRIPTION OF THE PREFERRED EMBODIMENTS

Figure 1:
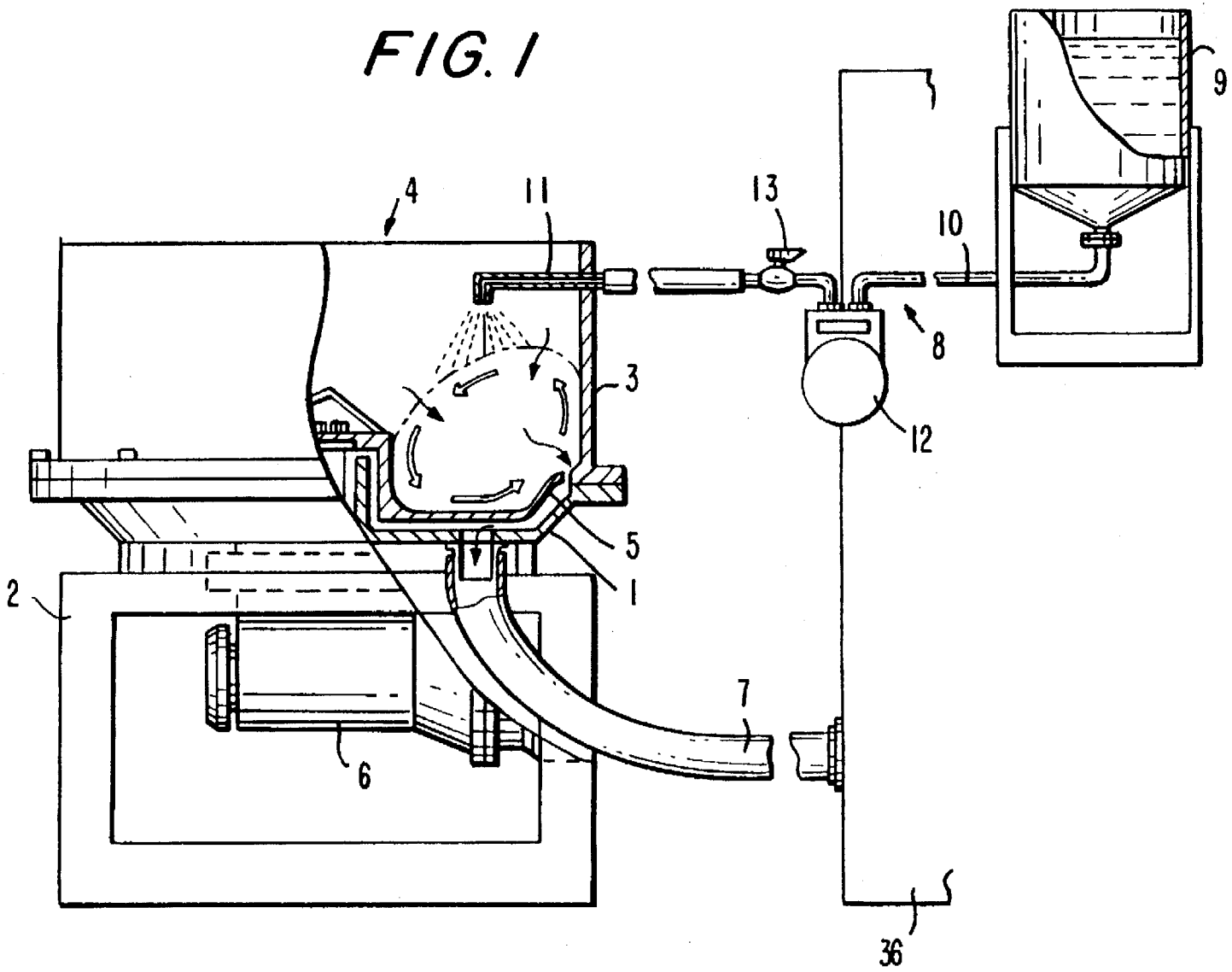
FIG. 1 is a fragmentary sectional view of a dry barrel finishing machine of a first embodiment of the present invention.

In FIG. 1 a first embodiment of a centrifugal-type dry barrel finishing machine is shown. The machine includes a base frame 2 on which a cup-shaped supporting body 1 is fixedly mounted. A hollow cylinder 3 is fixedly mounted on the supporting body 1. The cylinder 3 defines a wall of a barrel 4, the top end of which is open. A dish-shaped rotary plate 5 is rotatably mounted on the supporting body 1. The rotary plate 5 is rotated by a driver 6, such as a motor, so that a mass flows in the barrel 4. A suction pipe 7 is provided below the barrel 4. The pipe 7 is connected at one end of it to a dust collector 36, and at the other end to a space or passage between the rotary plate 5 and the supporting body 1. The dust collector has a vacuum source (not shown) so that it sucks air in the barrel 4 with attrition dust caused by processing workpieces. The passage is narrow at the lower end of the wall 3 so that it prevents the mass, i.e., workpieces and media, from passing through it. The passage may be broad enough to enable the mass to pass through it. In that case the passage must be covered by a filter or mesh.

The dry barrel finishing machine includes a liquid supply device, i.e. a media wetting device, to spray or drip a solution on the media in the barrel 4 so that it is wet the least amount possible. The solution my include a rust preventive, deceasing agent, or surface active agent, as required. The device 8 includes a liquid tank 9, a faucet 11, and a flow meter 12, and a valve 13 to adjust the rate of flow of the solution from the tank 9 through a connecting pipe 10 into the flow meter 12. A suitable amount of the solution is added by the media wetting device 8 so that only the surface of the media is wetted, but not the inside.

Now the operation of the dry barrel finishing machine is explained. First, a mass that includes workpieces, and media that includes a resin binder such as a polyamid resin that absorbs moisture, is put in the barrel 4, and the air in it is sucked by the dust collector 36. Then the barrel 4 is rotated by the driver 6. After the barrel is operated for a while, the device 8 starts spraying or dripping the solution so that the surface of the media is wetted. The sprayed or dripped solution vaporizes due to the hot mass, which was heated by its attrition, and deprives it of the heat and cools it. If a lot of a solution were to be added, the media would soften and break during attrition, and would lose its abrading ability. Per tests, preferably the amount of the solution to be added to the media is 0.005–0.2%/min. in weight in relation to typical media.

The solution may be sprayed or dripped continuously or successively. Selection of either spraying or dripping the solution, or doing so continuously or successively, depends on the amount, material, and shapes of the workpieces and the media material.

By a suitable amount of solution being sprayed or dripped on the surface of the media, dust in the barrel 4 that is caused by the operation and that adheres to the surface of the mass is easily removed by the attrition between the media itself and between the media and the workpieces. Preferably, supplying the solution is stopped when almost the entire process of the surface finishing is completed, and the operation of the barrel is continued until the surfaces of the workpieces and the media become dry. Thus almost no stain remains on the surfaces of the workpieces. Although the time in which the barrel continues to be operated alter the processing is almost completed varies depending on whether the air flow through the mass is caused by the dust collector, it is 5–10 minutes, for example, when media of 10 kg is put in the barrel, which has a capacity of 40 liters, and a solution of 7 ml/min. is added, and the workpieces are abraded for 90 minutes.

In this method the removed dust is carded by air sucked by the dust collector. The dust collector and the other associated elements that enable an air flow to pass through the mass are not essential. However, such elements can cool the mass and carry the dust out of the barrels, thus eliminating post-treatments.

When dressing the used media is desired, it is put in a barrel such as the barrel 4. Then the barrel is rotated, and a suitable amount of a solution is sprayed. Therefore, any dust that strongly adheres to the surface of the media is removed. Further, the media is self-sharpened. Thus the dressing is completed.

Figure 2:
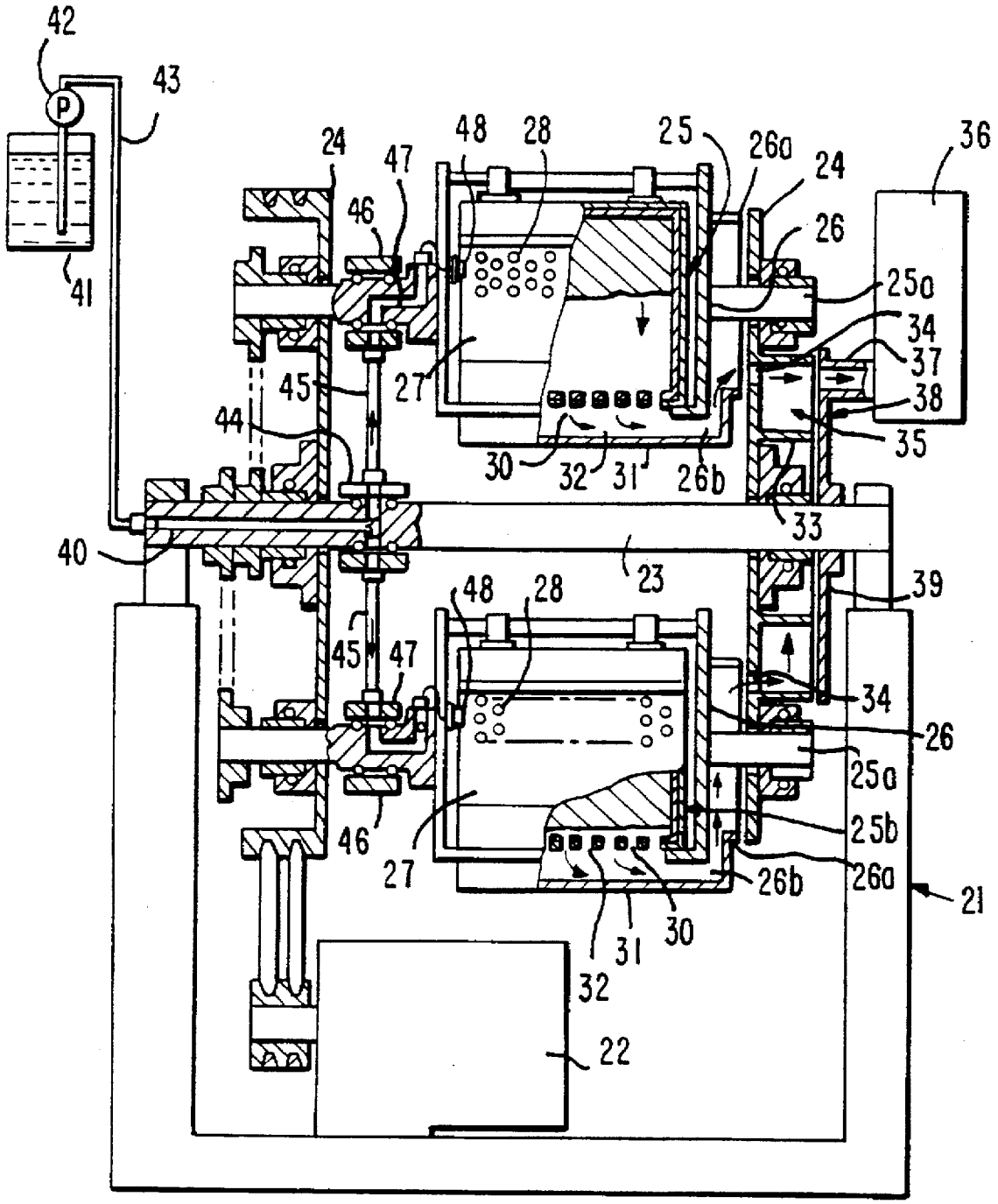
FIG. 2 is a fragmentary sectional view of a dry barrel finishing machine of a second invention of the present invention.

In FIG. 2 a second embodiment of the dry barrel finishing machine is shown. This finishing machine is also a centrifugal type, but it includes a plurality of barrels which revolve around an axis of revolution and rotate about their axes of rotation.

The finishing machine includes a main body 21, a driver (motor) 22, and a dust collector 36. The motor 22 is mounted on the base body 21. The motor 22 is connected to one of turrets 24, 24, which art fixedly mounted on the ends of a revolving shall 23, which is in turn rotatably mounted on the main body, Some pulleys are fixedly mounted on the revolving shaft 23 and shafts 25*a* of the barrels. The shafts of rotation 25*a* of the barrels 25 are rotatably mounted on the turrets 24, 24. Some toothed belts are entrained on the pulleys on the revolving shaft and the shafts of rotation so that the barrels rotate clockwise about their axes of rotation and revolve counterclockwise around the revolving shaft at the same speed as they rotate. Thus the barrels move like satellites.

Each barrel is comprised of a hollow cylinder or octagonal tube 27. The ends of the tube 27 are enclosed by end plates 25*b*. The tube 27 and the end plates 25*b* form a barrel body. It is supported on a frame 26, which is secured to the shaft 25*a* of rotation. The barrel body has an air-/intake part 28 (apertures) and an air and dust exhaust part 30 on its wall. A tray 31 and a short cylindrical duct 26*a* are attached around the barrel, thereby defining passages 32 and 26*b*. These passages communicate with passages 34, 35 of an annular duct 33, which is formed on one of the turrets 24. The passage 35 communicates with a connecting duct 37 and the dust collector 36, which dust collector 36 has a vacuum source, so that air enters the barrel and passes through the mass in the barrel and goes out of the barrel with attrition dust when the barrel 25 and dust collector 36 are operated.

A passage 40 is formed in the revolving shaft 23. It communicates with a liquid tank 41 through a tube 43 and a pump 42. The passage 40 also communicates with split tubes 45, which communicate with the barrels through tubes 47, embedded in the rotating shaft 25*a*. The tubes 45 and 47 are connected by means of a rotary joint. A faucet 48, having a nozzle, is attached to the distal end of the tube 47. The faucet 48 is disposed in the barrel. Thus a suitable amount of a solution or water is pumped up and sprayed in the barrel. This sprayed solution is borne by the air flow that comes from the air-intake part 28 and is spread over the mass or media to wet the surface of the mass for abrading the workpieces or to wet the surface of the media for dressing.

Figure 3:
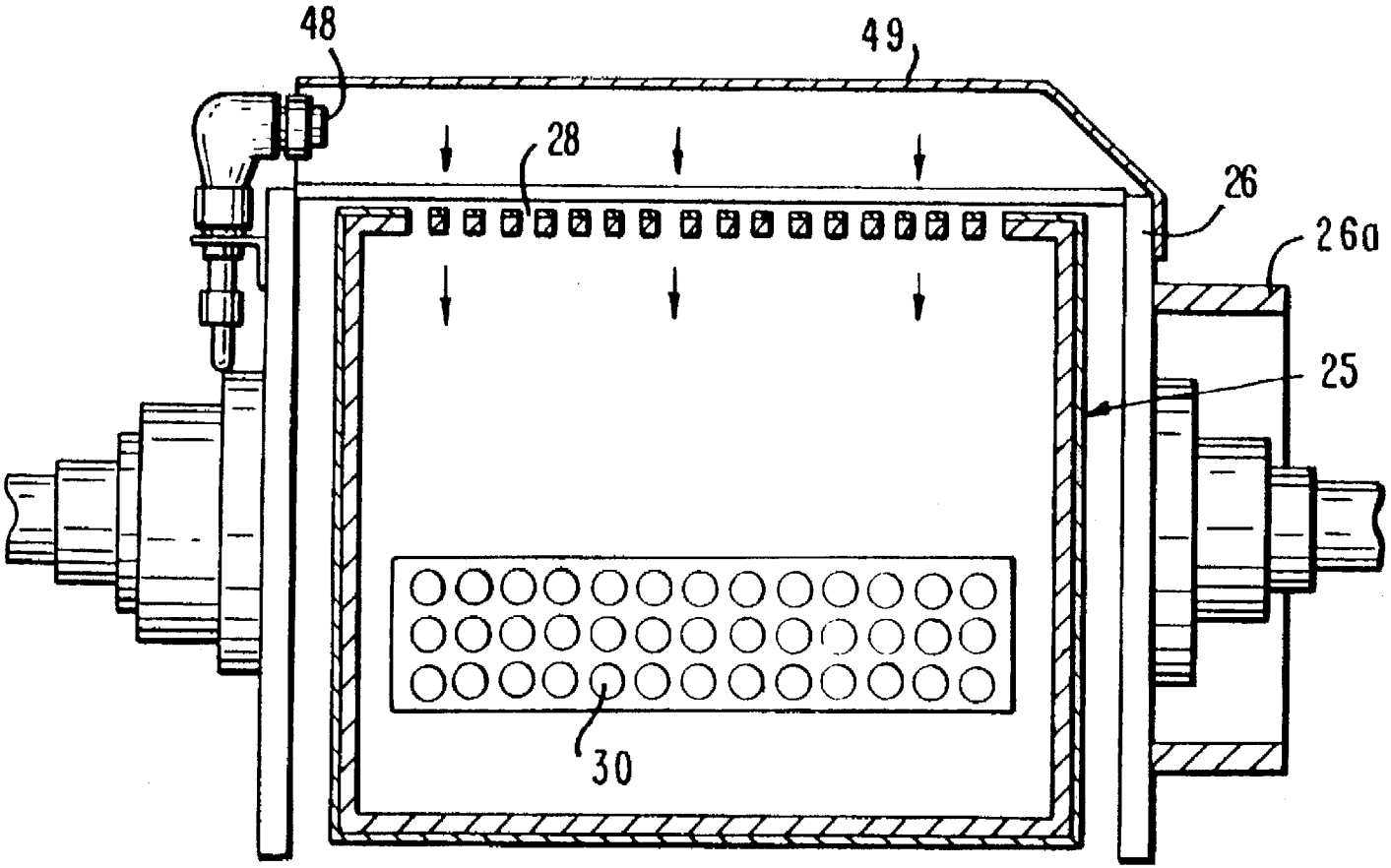
FIG. 3 is a fragmentary sectional view of an alternative spray device of the dry barrel finishing machine of FIG. 2.

In FIG. 3 an alternative arrangement of the faucet 48 is shown. In this arrangement a cover 49 is provided to define a space between itself and the air-intake part 28. The faucet 48 is disposed within the space. The sprayed solution is borne in the air flow in the same way as in FIG. 2.

Test 1

Figure 4:
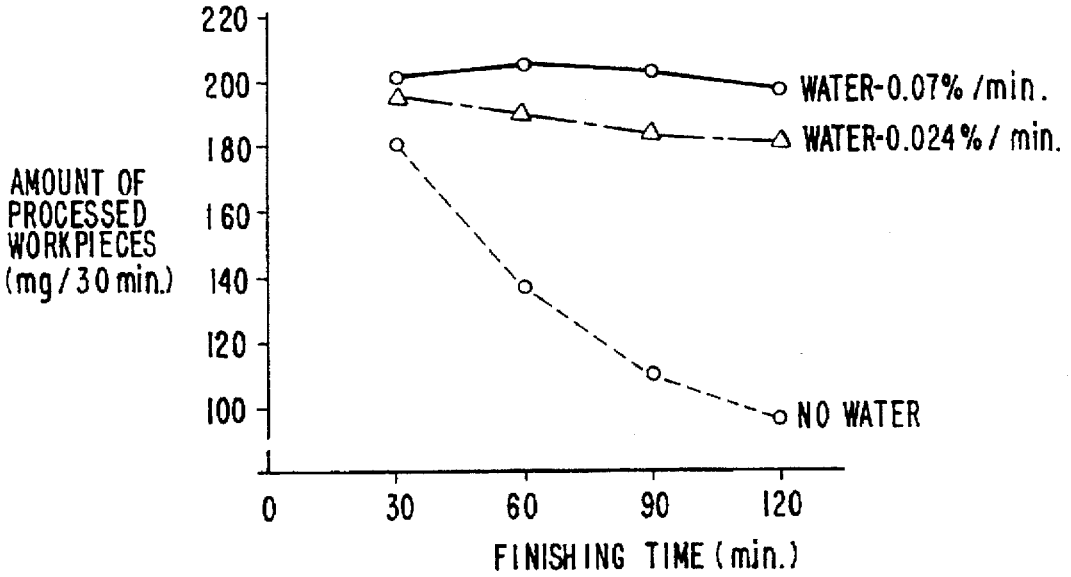
FIG. 4 is a graph of the results of Test 1.

Seventy kg of a high-power-type polyamid resin media (RT-15, made by Sintobrator, Ltd.) and 10 kg of aluminum die cast automobile parts were put in a centrifugal dry barrel finishing machine (EVF-08RD, made by Sintobrator, Ltd.). The rotary plate was rotated at the rate of 110 rpm. In the test, three cases were tested. In a first barrel, 0.143% water/min. (100 ml) was added as a solution, 0.014% water/min. (10 ml) was added in a second barrel, and no water was added in a third barrel. The results are as in the graph of FIG. 4. The amount of processed workpieces in the graph is the weight of the amount of the test pieces (each 22 mm in diameter and 15 mm long, weight of 48 g) lost per 30 minutes.

Per inspections by the naked eye, although when no water was added a color change to black was seen after processing, no color change was seen when water was added.

As a result of the inspections, it was confirmed that to add a solution was extremely effective in enhancing the rate of abrading.

Test 2

Figure 5:
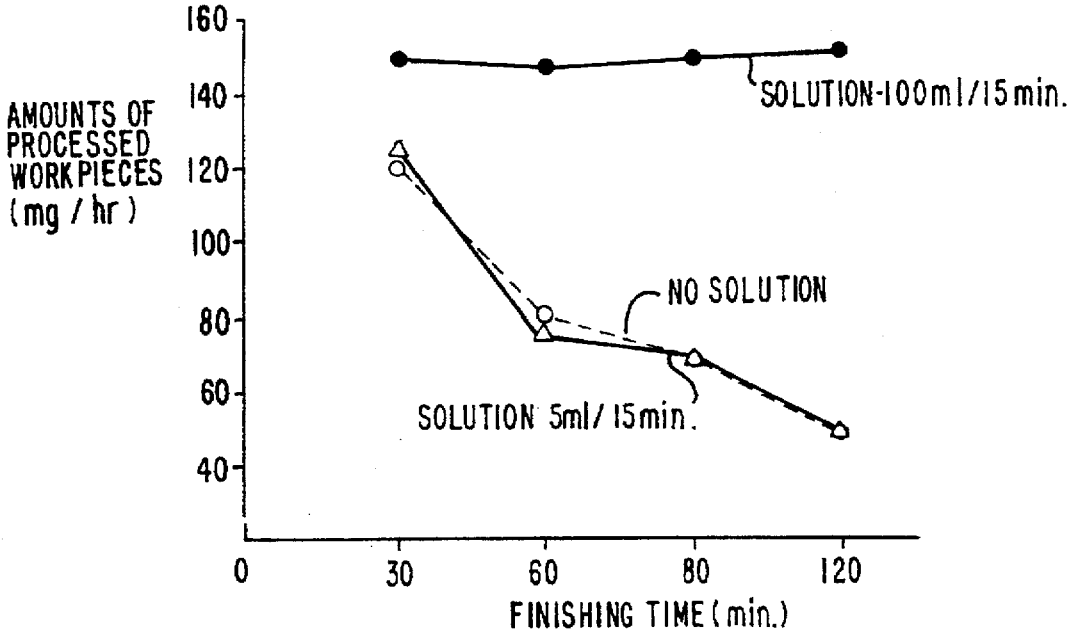
FIG. 5 is a graph of the results of Test 2.

Ten kg of the high-power-type polyamid resin media (RT-15, made by Sintobrator, Ltd.) and 2 kg of pressed steel electric switching parts were put in a centrifugal dry barrel finishing machine (EVF-04D, made by Sintobrator, Ltd.). The rotary plate was rotated at the rate of 200 rpm. In the test, two cases were tested. Water at 100 ml/15 min. (0.067%/min.), containing a 3% rust preventive, was added as a solution in a first barrel, and 5 ml/15 min. (0.003%/min.) of water, which is almost no water, in a second barrel. The results are as in the graph of FIG. 5. The amount of processed workpieces in the graph is as in FIG. 4.

From these results, also it was confirmed that to add a solution to wet only the surface of the media was extremely effective to enhance the rate of abrading. Further, it was confirmed that similar results were obtained whether the solution was added continuously or successively.

Test 3

Figure 6:
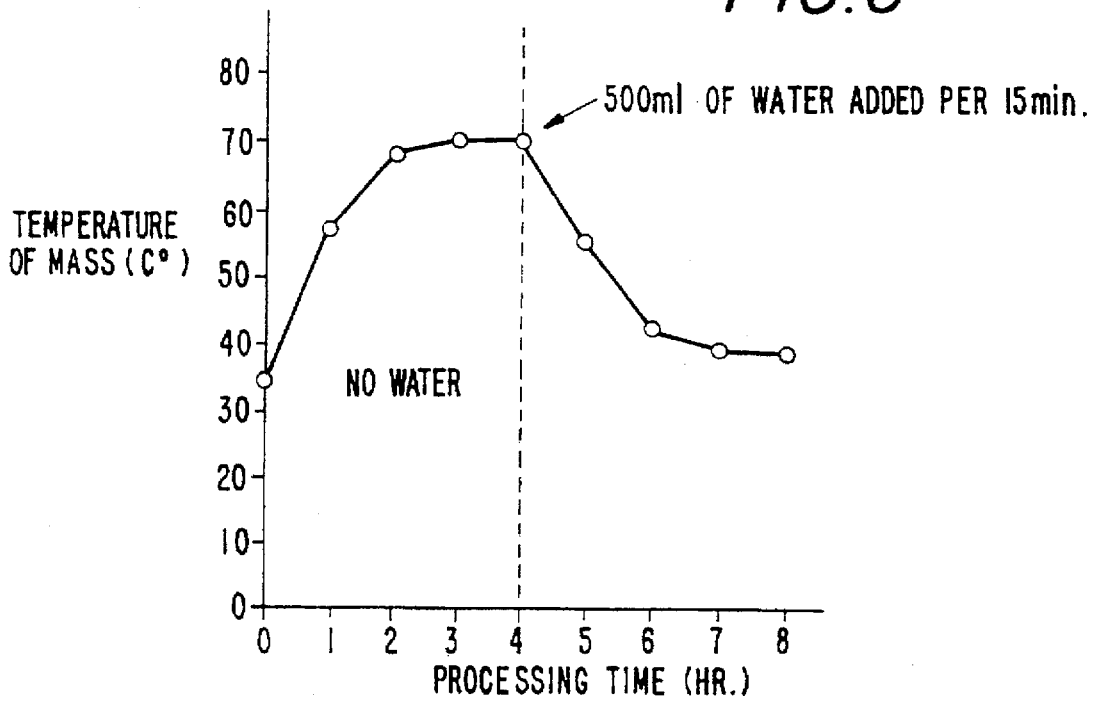
FIG. 6 is a graph of the results of Test 3.

Seventy kg of a middle-power-type polyamid resin media (RT-10, made by Sintobrator, Ltd.) and 30 liters of steel bearing laces were put in the centrifugal dry barrel finishing machine (EVF-08RD, made by Sintobrator, Ltd.). The rotary plate was rotated at the rate of 110 rpm. In the test, for the first four hours of abrading no water was added, as in a conventional dry barrel finishing, and then water at 500 ml/15 min. (0.133%/min.) was added. The variation in the temperature of the mass was observed. The results are as in the graph of FIG. 6.

From the results of these inspections it was confirmed that to add a solution was extremely effective in lowering the temperature of the mass.

Test 4

Figure 7:
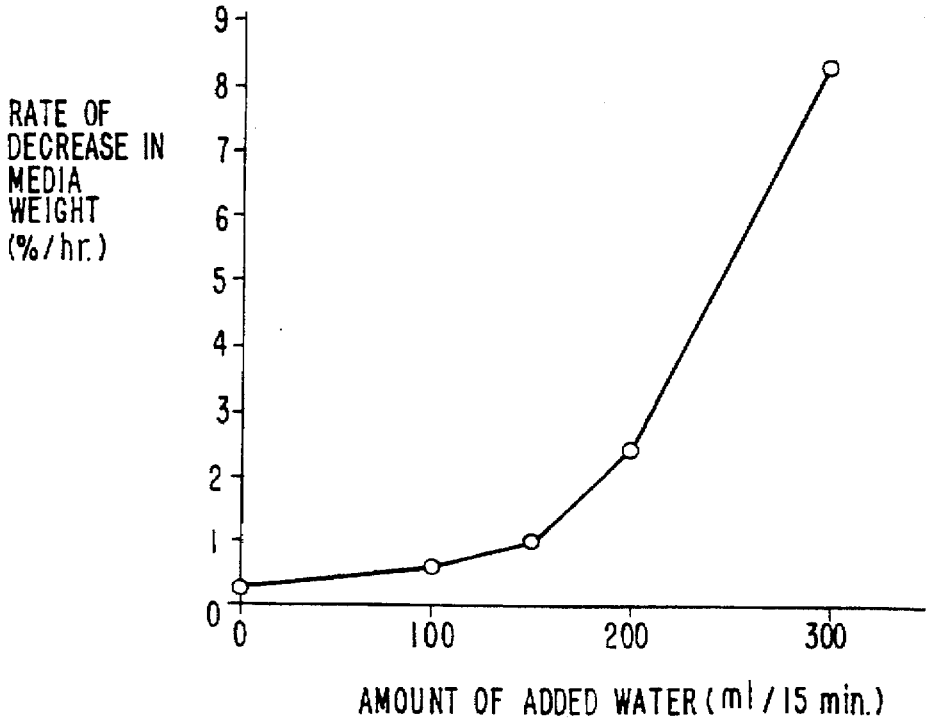
FIG. 7 is a graph of the results of Test 4.

Ten kg of the high-power type polyamid resin media (RT-15, made by Sintobrator, Ltd.) was put in the centrifugal dry barrel finishing machine (EVF 04D, made by Sintobrator, Ltd.). The rotary plate was rotated at the rate of 200 rpm to dress the media. In the test, four cases were tested. Water at 150 ml/15 min. (0.100%/min.) as a solution was added in a first barrel, water at 200 ml/15 min. (0.133%/min.) was added in a second barrel, water at 300 ml/15 min. (0.200%/min.) was added in a third barrel, and no water was added in a fourth barrel. The rates of the decrease in weight of the media are as in the graph of FIG. 7. By adding a suitable amount of water to wet only the surface of the media, the temperature of the media was lowered, and the time to dress them was shortened.

Test 5

Figure 8:
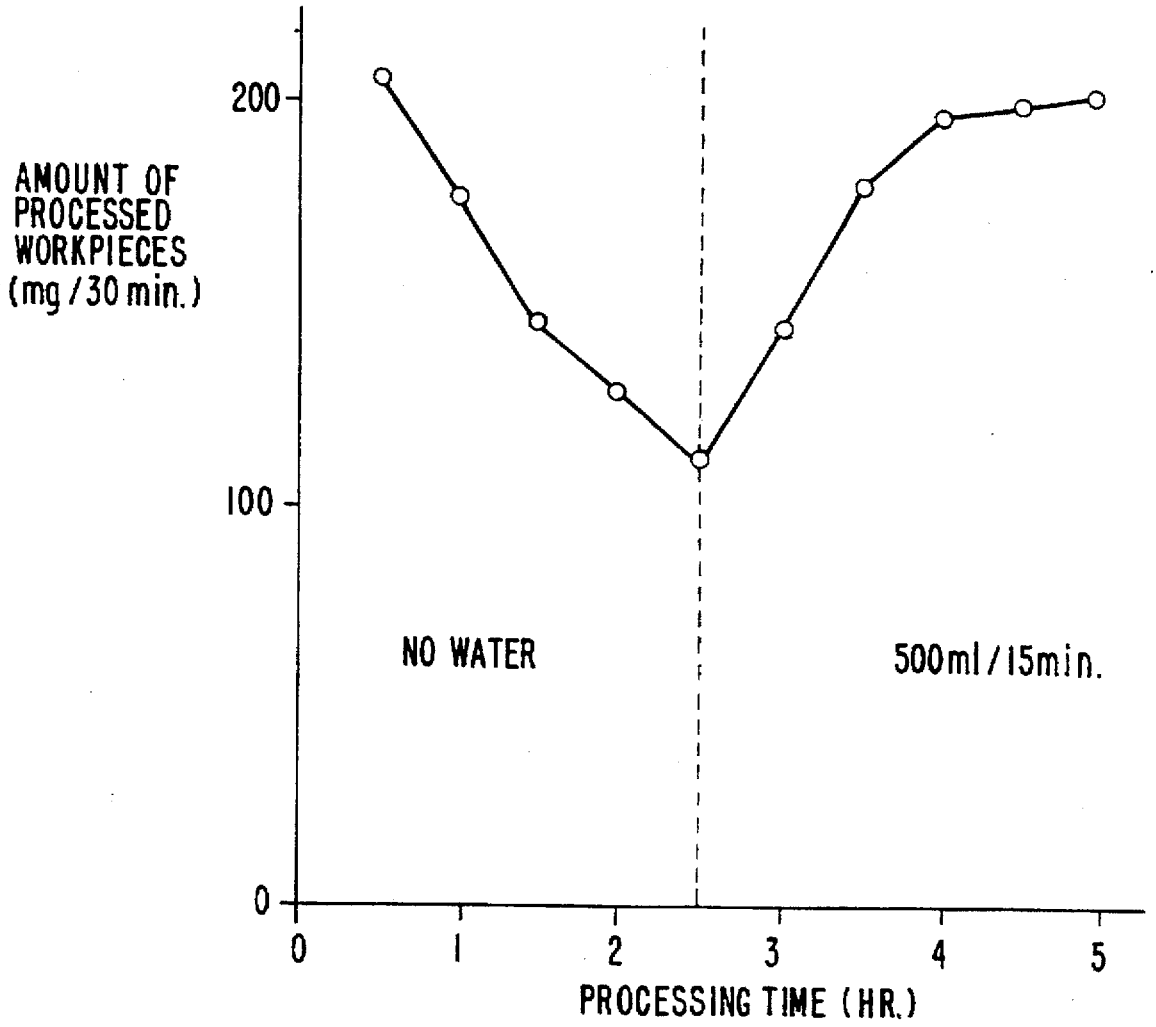
FIG. 8 is a graph of the results of Test 5.

Seventy kg of the high-power type polyamid resin media (RT-15, made by Sintobrator, Ltd.), 1500 pieces of steel shims (each 22 mm in diameter and 2.3 mm long), and a brass test piece (22 mm in diameter and 15 mm long weight of 48 g) were put in the centrifugal dry barrel finishing machine (EVF-08RD, made by Sintobrator, Ltd.). The rotary plate was rotated at the rate of 110 rpm. For the first two and half hours the mass was abraded by a conventional dry barrel finishing without water, then water at 500 ml/15 min. (0.048%/min.) was added. The amount of the processed test piece was observed. The results are as in the graph of FIG. 8.

From these results, it was confirmed that to add a solution to wet only the surface of the media was extremely effective to improve the low rate of abrading caused by the conventional dry barrel finishing without water.

Test 6

Six kg of the high-power-type polyamid resin media (RT-15, made by Sintobrator, Ltd.), 3 kg of pressed steel products or 2 kg of aluminum products, and two brass test pieces (each 22 mm in diameter and 15 mm long, weight of 48 g) were put in a centrifugal dry barrel finishing machine (SKC-32ED, made by Sintobrator, Ltd.) that has four barrels that rotate about their axes of rotation and that revolve around an axis of revolution. Each barrel has an 8-liter capacity. The barrels were rotated and revolved at the rate of 180 rpm. For the hours the mass was abraded by a conventional dry barrel finishing without water, and the rise in the temperature of the mass was observed. Then water at 10 ml/15 min. (0.022%/min.) was added, and the rate of abrading was observed. By adding a suitable amount of a solution, the temperature of the mass was lowered, and the time to dress the media was shortened.

From these results it was confirmed that to add a solution to wet only the surface of the media was extremely effective to improve the low rate of abrading caused by the conventional dry barrel finishing without water.

What we claim is:

1. A method of dry barrel finishing comprising:

providing at least one workpiece and abrasive media in a barrel of a dry barrel finishing machine;

operating the barrel so that said at least one workpiece is abraded by the media;

adding a suitable amount of a solution in the barrel such that only the surface of the media is wetted, but the inside of said media is not wetted; and stopping adding the solution while operating the barrel until said surface of said media dries.

2. The method of claim 1 wherein said providing comprises providing abrasive media that comprises abrasive grains and a polyamid resin that absorbs moisture.

3. A dry barrel finishing machine comprising:

a barrel for receiving abrasive media and in which workpieces are finished thereby producing attrition dust;

means for spraying or dripping a suitable amount of a solution in the barrel such that only the surface of said media is wetted, said suitable amount being 0.005–0.2%/min. in weight in relation to said abrasive media; and a dust collector having a vacuum source for sucking from said barrel air, said attrition dust, and said solution which has been vaporized.

4. The dry barrel finishing machine of claim 3, wherein said barrel of said finishing machine is rotatable in a fixed position about a vertical axis, and wherein said barrel has an open top end.

5. The dry barrel finishing machine of claim 3, wherein said finishing machine includes a plurality of barrels that revolve around an axis of revolution and that rotate about axes of rotation thereof.

6. The dry barrel finishing machine of claim 3, wherein said finishing machine includes means to supply an air flow that passes through said media in said barrel.

7. A method of dry barrel finishing comprising;

providing at least one workpiece and abrasive media in a barrel of a dry barrel finishing machine;

operating the barrel so that the workpiece is abraded by the media; and adding a suitable amount of a solution in the barrel such that the surface of the media is substantially wetted, but the inside of said media is not wetted, said amount of said solution being 0.005–0.2%/min. in weight in relation to said media.

8. The method of claim 7 wherein said providing comprises providing abrasive media that comprises abrasive grains and a polyamid resin that absorbs moisture.

9. A method of dressing abrasive media in a barrel of a dry barrel finishing machine, comprising;

providing abrasive media in the barrel of the finishing machine, the abrasive media comprising abrasive grains combined by a water-absorbable resin binder;

operating the barrel so that said media flow in the barrel; and adding a suitable amount of a solution in the barrel such that the surface of said media is substantially wetted, but the inside of said media is not wetted.

10. The method of claim 9 wherein said adding comprises adding a solution of 0.005–0.2%/min. in weight in relation to the abrasive media.

11. An apparatus for spraying or dripping a suitable amount of a solution in a barrel of a dry barrel finishing machine, said barrel being adapted to receive water-absorbable abrasive media and a workpiece to be abraded, said barrel having a suction passage at a lower portion thereof, such that only the surface of said water-absorbable media is wetted, said suitable amount being 0.005–0.2%/min. in weight in relation to said abrasive media, and such that air in said barrel bearing attrition dust produced and said solution vaporized by the barrel finishing is sucked through said suction passage.

* * * * *

UNITED STATES PATENT AND TRADEMARK OFFICE

CERTIFICATE OF CORRECTION

PATENT NO. : 5,733,172

DATED : March 31, 1998

INVENTOR(S) : Nishimura et al.

It is certified that error appears in the above-indentified patent and that said Letters Patent is hereby corrected as shown below:

Title page,Item [75]

Inventors, after "Satoshi Niwa," "Ama-gum" should be "Ama-gun".
Column 1, line 21, "charting" should be -- changing --.
Column 2, line 46, "deceasing"should be -- degreasing --.
Column 3, line 16, "alter" should be -- after --.
Column 3, line 44, "24,24" should be -- 24, --.
Column 3, line 44, "art" should be -- are --.
Column 3, line 45, "shall" should be -- shaft --.
Column 3, line 46, "body," should be -- body. --.
Column 3, line 59, "air-/intake" should be -- air-intake --.
Column 5, line 8, "EVF 04D," should be -- EVF-04D, --.
Column 5, line 24, "long" should be -- long, --.
Column 6, line 28, ";" should be -- : --.
Column 6, line 42, ";" should be -- : --.

Signed and Sealed this

Sixth Day of June, 2000

*Attest:*

*Attesting Officer*

Q. TODD DICKINSON

*Director of Patents and Trademarks*